US009091167B2

(12) United States Patent
Craig

(10) Patent No.: US 9,091,167 B2
(45) Date of Patent: Jul. 28, 2015

(54) SELF DRILLING ROCK BOLT

(75) Inventor: Peter Harold Craig, Cooyal (AU)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 12/192,526

(22) Filed: Aug. 15, 2008

(65) Prior Publication Data

US 2009/0074516 A1 Mar. 19, 2009

(30) Foreign Application Priority Data

Aug. 17, 2007 (AU) ..... 2007904456

(51) Int. Cl.
*E21D 21/00* (2006.01)

(52) U.S. Cl.
CPC .... *E21D 21/0033* (2013.01); *E21D 2021/0053* (2013.01)

(58) Field of Classification Search
CPC ..... E21D 21/0046; E21D 2021/0066; E21D 21/0033
USPC ..... 405/259.1, 259.3, 259.5
See application file for complete search history.

(56) References Cited

U.S. PATENT DOCUMENTS

| | | | | |
|---|---|---|---|---|
| 4,750,887 | A * | 6/1988 | Simmons | 405/259.2 |
| 5,374,140 | A * | 12/1994 | Standish et al. | 405/259.5 |
| 5,458,442 | A * | 10/1995 | Ashmore | 405/302.2 |
| 5,785,463 | A * | 7/1998 | Eaton et al. | 405/302.2 |
| 6,779,950 | B1 * | 8/2004 | Hutchins | 405/259.1 |
| 2006/0078391 | A1 * | 4/2006 | Stankus et al. | 405/259.4 |
| 2008/0260471 | A1 * | 10/2008 | Simmons et al. | 405/259.1 |

FOREIGN PATENT DOCUMENTS

CN 1548659 A 11/2004

* cited by examiner

*Primary Examiner* — Benjamin Fiorello
(74) *Attorney, Agent, or Firm* — The Webb Law Firm

(57) ABSTRACT

The present invention relates to a self drilling rock bolt which may be used in mining applications. Self drilling rock bolts are typically formed by rebars having an axially extending central passageway for water passage and post grouting. Costs of such hollow steel rebars is quite high. In the present invention, a rock bolt is formed from a hollow tubular member which may be steel pipe, and a reinforcing arrangement comprising prestressed concrete type steel strand wound around the outside of the hollow tubular member.

14 Claims, 5 Drawing Sheets

SELF DRILLING ROCK BOLT

FIELD OF THE INVENTION

The present invention relates to a rock bolt and, particularly, but not exclusively, to a self-drilling rock bolt which may be used in mining applications.

BACKGROUND OF THE INVENTION

Rock bolts for supporting structures e.g. roofs of passageways in mines are well known. There are many different types of rock bolts. A rock bolt generally consists of an elongate shank (length will generally depend upon the material which the rock bolt is intended to secure) having a distal end (the end which in use is fixed furthest within the rock), and a proximal end (the end, in use, which is closest to the surface of a rock and, in many cases, may actually project from the rock surface), or "tail end".

Rock bolts are fixed in elongate boreholes (not much wider than the rock bolt) which is drilled in the rock. In use, a bearing plate is secured at the tail end of the rock bolt fast against the rock surface. The rock bolt and bearing plate assembly operate to support the rock. Many rock bolts may be used to support structures. For example, in mines rock bolts may be used to support passageways.

Installation usually requires drilling of the borehole by using a drill rig and a drill steel (a long steel rod with a drill bit on the end). The drill steel is then removed from the borehole. Resin (or "grout") is inserted into the borehole, then the rock bolt itself is inserted and tightened up against the bearing plate.

Some rock bolts incorporate point anchoring mechanisms, which can be manipulated post insertion of the rock bolt to mechanically interfere with walls of the borehole in order to firmly secure the rock bolt.

The conventional procedure for installing rock bolts involves drilling a bore hole using a drill steel, removing the drill steel, inserting resin and a rock bolt and securing the rock bolt. "Self drilling" rock bolts are also known. These generally incorporate a drill bit as part of or connected to the distal end of the rock bolt, a tail end being attachable to a drill rig in order to drill the bore hole with the rock bolt. Once the hole is drilled, the rock bolt is retained in the hole.

One such self drilling rock bolt is disclosed in the Applicant's co-pending Australian patent application number 2006903922, entitled "Rock Bolt" and filed on 20 Jul. 2006. The disclosure of this provisional patent application is incorporated herein by reference. This earlier application discloses a self drilling rock bolt which includes a point anchoring mechanism.

Rock bolts are required to be high strength, typically over 30 tonnes ultimate tensile strength. Rock bolts are typically bonded to the borehole walls by resin. It is advantageous for the surface of the rock bolt to be deformed in order to provide high bond strength between the bolt/resin/rock interfaces.

Self drilling rock bolts have typically been rebars (strong steel bars) having an axially extending central path for water passage (and post grouting). The cost of making such hollow steel bars is quite high, and is uneconomical for high density rock support required by many underground mines.

It has been proposed to use a solid rebar with an outer sleeve for water passage during drilling. The outer sleeve, however, typically reduces the bonding between the rebar and the bore hole wall.

It has also been proposed to use high strength pipe which has limited surface deformations, if any, and is expensive and difficult to manufacture in the required high strength material.

SUMMARY OF THE INVENTION

In accordance with a first aspect, the present invention provides a rock bolt, comprising a shank portion comprising a hollow tubular member and a reinforcing arrangement in use operating to reinforce the hollow tubular member.

In an embodiment, the reinforcing arrangement also provides deformations in an outer surface, whereby to improve bonding in a rock bolt borehole.

In an embodiment, the reinforcing arrangement comprises a reinforcing material mounted about a wall of the hollow tubular member. In an embodiment, the reinforcing material is mounted about an outer wall of the hollow tubular member.

In an embodiment, the reinforcing arrangement is strand wrapped around an outer wall of the hollow tubular member. In an embodiment, the strand is metal strand and, in an embodiment, is "prestressed concrete" (PC) type steel strand. In an embodiment, the strand itself may be "spiral type" PC wire, which advantageously adds further deformation on a smaller scale to the already deformed outer surface formed by the strands. In an embodiment, the strand may be indented in order to provide extra deformation.

In an embodiment, where the reinforcing arrangement comprises metal strand, the metal strand may be secured at an end of the hollow tubular member by a securing member arranged to receive ends of the metal strand and secure them to the hollow tubular member. In an embodiment, the securing member is a nut having a threaded portion arranged to seat on a corresponding threaded portion on the hollow tubular member, and comprising passageways for receiving ends of the metal strand. In manufacture, the nut may be rotated on the threaded portion to rotate the metal strand into position around the hollow tubular member and secure it to the hollow tubular member. A nut may be provided at each end of the shank portion for this purpose.

In an embodiment, a wedge mechanism may be arranged to secure the metal strand.

The shank (which, in an embodiment, forms the majority of the length of the rock bolt) is, in an embodiment, formed of hollow pipe, which may be commercially available. In an alternative embodiment, the pipe may not be the standard diameter and is specially made.

Using rigid hollow pipe made by conventional high volume methods and metal strand reinforcement members in accordance with an embodiment of the present invention, has the advantage that it is typically less expensive than hollow rebar yet strong enough to achieve similar or even much higher tensile strength than currently used for primary rock support. In an embodiment, the hollow pipe may be of mild steel (10-22 mm diameter), being rigid and strong enough to drill the single hole. When the rock bolt is subsequently secured to the borehole walls by either resin or mechanical anchor, the reinforcement arrangement can be tensioned which provides additional rock reinforcement by means of pre-stressing the rock mass.

Where the reinforcing arrangement is a metal strand, up to 95% and perhaps even more of the load may be carried by the strand.

In an embodiment, the rock bolt may be a self drilling rock bolt including the shank, a distal end at one end of the shank and a tail end at the other end of the shank. The rock bolt may incorporate a point anchoring mechanism, such as described in the Applicant's co-pending application referenced above.

BRIEF DESCRIPTION OF THE DRAWINGS

Features and advantages of the present invention will become apparent from the following description of embodiments thereof, by way of example only, with reference to the accompanying drawings, in which.

DETAILED DESCRIPTION OF EMBODIMENTS

Figure 1:
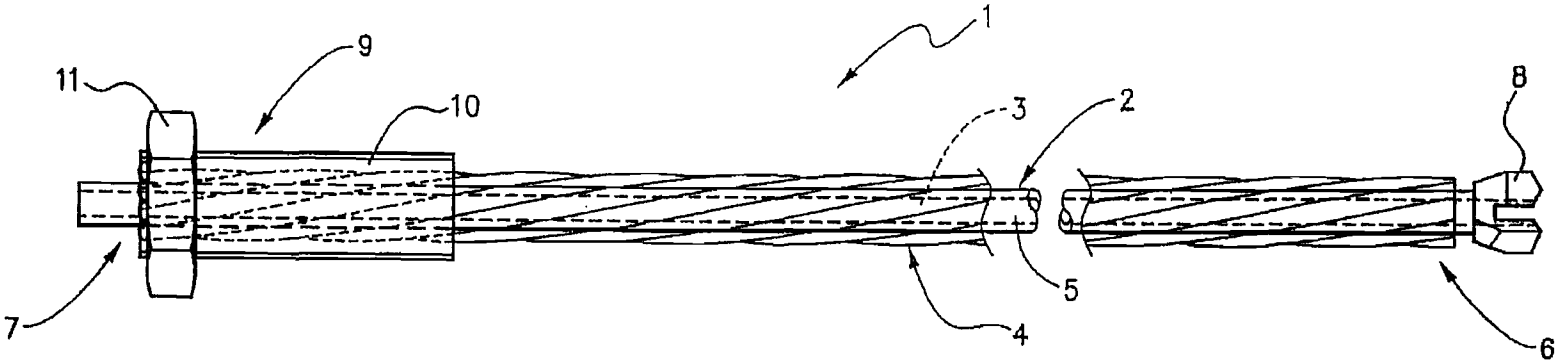
FIG. 1 is a side view of a rock bolt in accordance with an embodiment of the present invention.

An embodiment of the present invention will now be described with reference to FIG. 1.

A rock bolt, generally designated by reference numeral 1 comprises a shank 2. The shank 2, in this embodiment, is comprised of a hollow tubular member 5 and a reinforcing arrangement 4. In this embodiment, the hollow tubular member 5 has a longitudinally extending passageway 3 which extends the length of the shank 2. In this embodiment, the hollow tubular member 5 is a hollow tube formed from rigid hollow pipe.

The reinforcing arrangement 4, is of high strength and forms a deformed outer surface which provides high load transfer through the cementitious grout/resin which is placed between the strands and borehole wall. In this particular example, the reinforcement arrangement is in the form of reinforcing strand which is wound around the outside of the hollow tube 5. In this embodiment, the strands 4 are high tensile "PC" steel strand wound about the outside of the hollow tubular member 5. The strand is welded to the hollow tubular member 5 at a distal end 6 of the rock bolt 1. The deformations in the outer surface are formed by the nature of the strands, not being a smooth outer surface. As well as the nature of the wound strands providing deformed surface, additional deformation may be added by indenting the strands or using "spiral type" PC wire.

In more detail, the rock bolt 1 also includes, at the distal end 6, a drill bit 8 mounted on the tubular member 5 to enable self drilling of the rock bolt 1.

In order to secure together the reinforcing strands 6, for purpose of tensioning and load bearing, a securing arrangement 9 is arranged at the tail end 7 of the rock bolt 1. The securing arrangement 9 includes a cylinder 10 incorporating a wedge arrangement in the interior of the cylinder. The cylinder and wedge are mounted about the outer surface of strand 6 and the cylinder is then deformed onto the wedge so that the wedge bites into the strand 6 to provide further securing. The hollow tubular member provides the radial resistance to maintain the strands in position against the wedge compressing radially inwards.

Figure 2B:
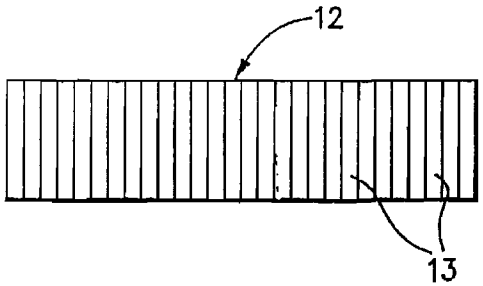
FIG. 2B is a plan view showing an inner surface of a securing insert of the securing arrangement of FIG. 2A.
Figure 2A:
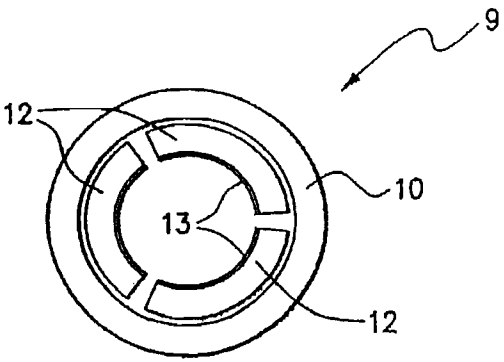
FIG. 2A is a cross-section through a securing arrangement of the embodiment of FIG. 1.

The securing arrangement 9 is shown in more detail in FIGS. 2A and 2B. Within the cylinder 10 there are mounted three inserts 12, which, in this embodiment, are not "wedge" shaped as such but part cylindrical sections. FIG. 2B shows a front on plan view of an inside face of one of the inserts 12. In use, the inside face 12 butts against the strand 6. The inside face 12 is provided with a plurality of serrations or teeth 13. Alternatively, this may be in the form of a thread 13.

When the cylinder 10 is compressed over the inserts 12 the serrations/teeth 13 penetrate or otherwise interfere with the strand 6 to secure the strand 6. The compression is carried out by machine operation during manufacture of the rock bolt 1. This is a swage type of end fitting.

Once the cylinder 10 has been compressed about the inserts 12, an outer thread is formed on the outside of the cylinder 10, for receiving retention nut 11.

As an alternative to the part cylindrical inserts, wedge shaped inserts could be used.

The outer surface of the cylinder has a thread formed on it to receive a cooperatively threaded tension nut 11. In operation, the tension nut 11 may be tensioned against a mounting plate (not shown) hard up against the rock face when the rock bolt is in place.

To install the rock bolt, the tail end 7 of the shank 2 is placed into a rock drilling motor. A drill rig rotates the rock bolt 1 and the drill bit 8 drills into the rock. As drilling proceeds, water or other cooling fluid may be provided via the central passageway 3. The whole tubular member provides sufficient strength to provide for rotation/impact of the drilling bit into the rock. When the rock bolt is into the rock at sufficient depth, cementitions grout/resin is injected into the hollow tube to flow out of the drill bit and down the bolt between the borehole wall and reinforcing strand. Alternatively, grout can be pumped upwards between the borehole and the outer circumference of the rock bolt 1. The passageway 3 in this case is used as a breather tube to allow air to escape as grout fills the voids. The grout is allowed to cure and secure the reinforcing strand to the rock. The tension nut is then rotated hard up against the mounting plate in order to tension the bolt and plate against the rock face.

The reinforcing strand, when bonded to the borehole wall with resin, acts to provide the rock reinforcement. This is achieved through having an overall deformed surface/circumference to bond to the rock and the required very high strength to carry the load transferred to the reinforcing member through rock movement.

A further embodiment will now be described with reference to FIGS. 3 and 4. The same reference numerals have been used in these figures to identify similar features of this rock bolt to the rock bolt of FIG. 1 and no further description will be given of these features.

In this embodiment, the rock bolt 20 comprises an alternative securing member to secure the reinforcement arrangement 4. In more detail, a securing member arranged at the tail end 7 of the rock bolt 20 comprises drive nut 21. The drive nut 21 is fixed to the hollow tubular member 2 by way of a thread on the inside of the drive nut 21 and outside of a portion of tubular member 5. The drive nut 21 also includes a number of bores 23 for receiving strands 4 of the reinforcing arrangement. The strands have a button head 26 formed onto the ends for securing against the bores 23. A reinforcing nut 24 at the distal end 6 of the rock bolt 20 is arranged for mounting on a threaded portion 25 of the distal end 6. In manufacture, when the drive nut 21 is twisted in a clockwise direction, it will cause winding on the originally straight strands 4 to form a helically twisted formation.

In operation, when the rock bolt 20 has been drilled into the bore hole, grouting may then be carried out via the central passageway 3 as usual.

In this embodiment, "button distals" 26 may be formed at the ends of the reinforcing strands 4, to secure the strands within the passageways 23 in drive nut 21 (and also in the securing nut 24).

Figure 5C:
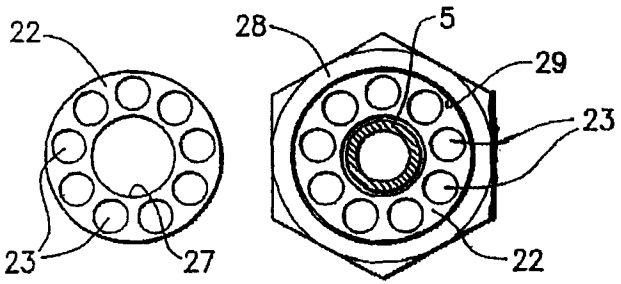
FIGS. 5A, 5B and 5C are details of an alternative securing member for use with an embodiment of the present invention.
Figure 5B:
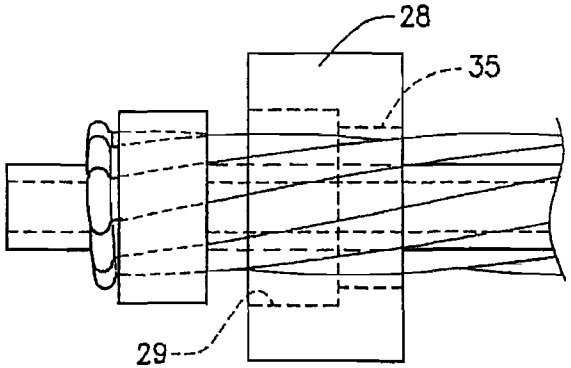
Figure 5A:
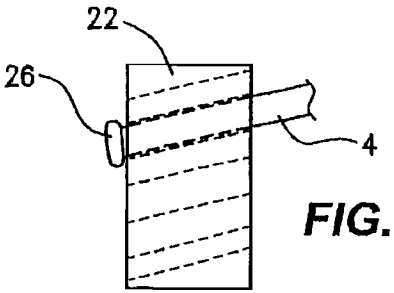

A variation on the securing member for securing the reinforcement arrangement 4 is illustrated in FIGS. 5A, 5B and 5C.

In this alternative, the securing member is in two parts. One part comprises a cylindrical end block 22 which includes circumferential bores 23 for receiving the ends of reinforcing strand 4. The end block 22 may be secured to the hollow tubular member 5 by welding or threads on its inner surface 27.

Referring to FIG. 5A, reference numeral 26 clearly indicates a forged button on the end of each individual wire of the strand 4. The button-end 26 is formed after the wires are inserted through the passageways 23 in the end block 23.

The other part of the securing member comprises a tensioning nut 28, which includes a nut 28 having a cylindrical recess 29 which is arranged to receive the end block 22 to seat therein, as best illustrated in FIG. 5C. The tensioning nut also includes a passageway 35 which extends around the outside of the strand 4. A thread may be provided at this portion of the strand 4 to engage with a corresponding thread on the inside of the passageway 35.

In operation, the rock bolt 20 is drilled into the rock. After grouting, the tensioning nut 29 may then be rotated up against a mounting plate (not shown) to post-tension the rock bolt 20.

In the alternative using the securing member 21, no post-tensioning is required and drilling occurs until the securing member 21 is drilled up against the rock or a mounting plate (not shown), and then grouting is introduced into the bore hole.

Figure 3:
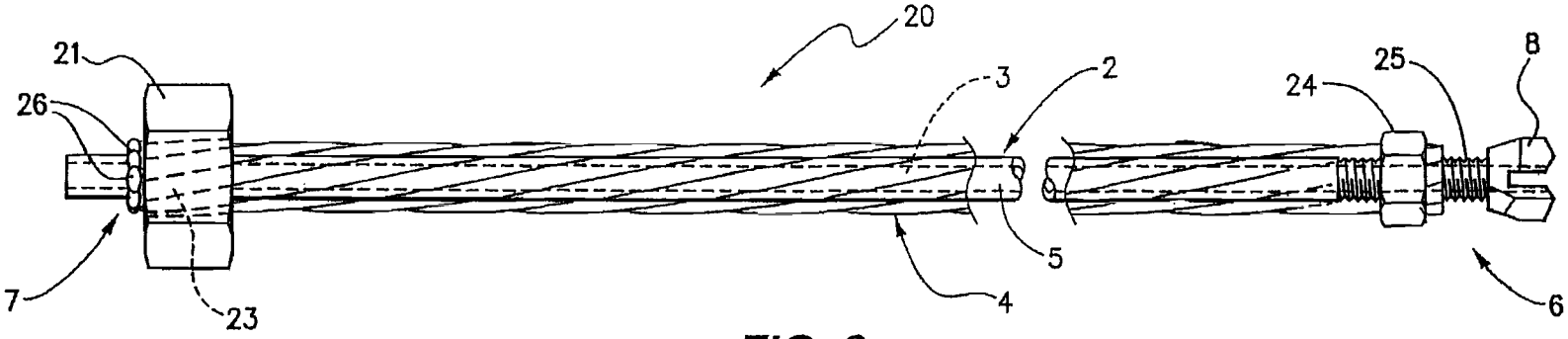
FIG. 3 is a side view of a rock bolt in accordance with a further embodiment of the present invention.
Figure 4:
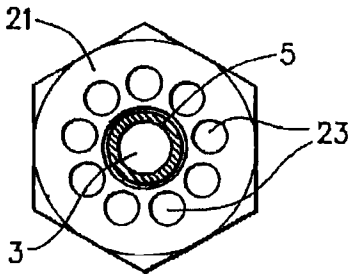
FIG. 4 is an end view from one end of the rock bolt of FIG. 3.
Figure 6:
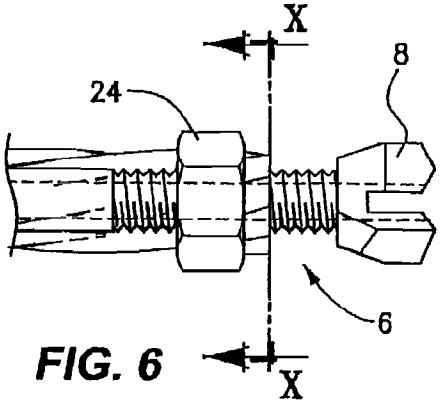
FIG. 6 is a detail of a distal end of the rock bolt of the embodiment of FIG. 3.

FIG. 6 shows a detail of the distil end 6 of the rock bolt of FIG. 3. The securing nut 24 has bores 36 for receiving reinforcing strand 4. No button heads are required on the strand for this end. The nut 24 and strand 4 could be welded to the tubular member 5 if required. As this end 6 of the bolt 20 is grouted within the rock, less strength is required than at the proximal end 7 of the rock bolt 20.

Figure 10:
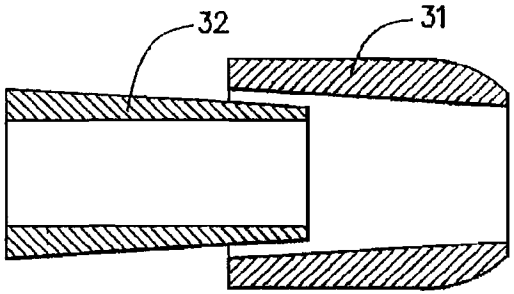
FIG. 10 is a detailed exploded view of a reinforcing member of the embodiment of FIG. 8.

A further embodiment will now be described with reference to FIGS. 8, 9 and 10. Again, the same reference numerals have been used to denote features which are the same as already described for previous embodiments, and no further description will be given of these features.

In the rock bolt 30 of this embodiment, an alternative securing arrangement 31 is utilised to assist in securing the reinforcement strands 4 and tensioning the rock bolt 30. A reinforcing member 31 includes a tapered internal surface 33 and wedges 32 that are arranged to slide against the tapered internal surface 33. In operation, the member 31 is tensioned against a mounting plate when the rock bolt 30 is in place within the bore hole. Upon subsequent loading as the member 31 is pulled up against the mounting plate, it forces the wedges to bite into the strands 4 and secure the strands 4.

Figure 9:
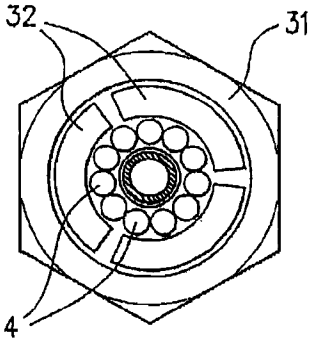
FIG. 9 is a view from one end of the rock bolt of FIG. 8.
Figure 7:
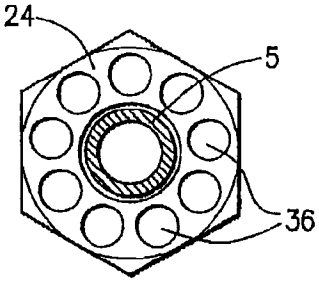
FIG. 7 is a cross-section on line XX of FIG. 6.
Figure 8:
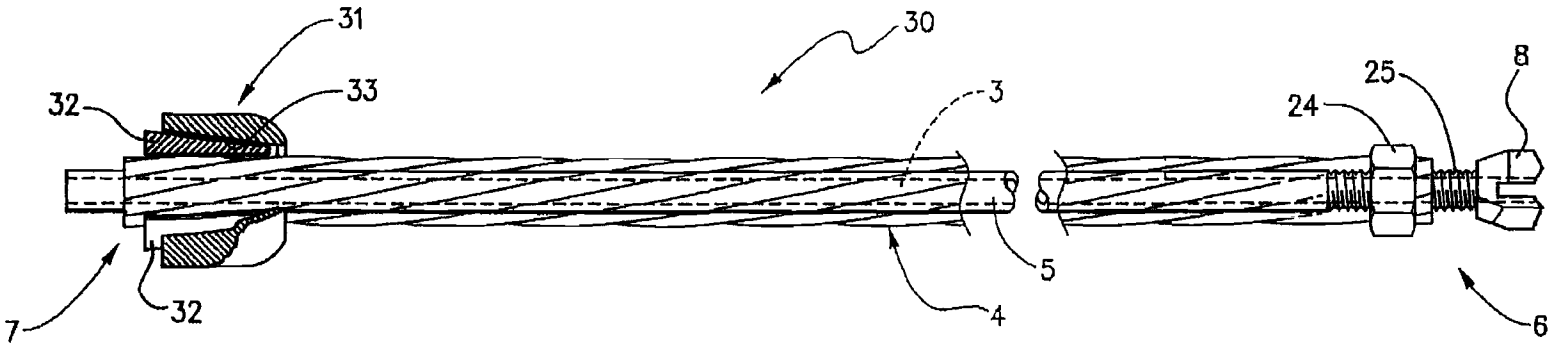
FIG. 8 is a side view of a rock bolt in accordance with yet a further embodiment of the present invention.

In the embodiment of FIGS. 8 and 9, there are three wedges 32. An exploded view of the barrel 31 and wedge 32 arrangement is shown in FIG. 10. Again, although not clearly shown in FIG. 10, there are 3 wedges 32. It will be appreciated that there may be more or less wedges.

In operation, the rock bolt 30 is drilled into the rock up until the mounting plate and barrel are tensioned against the rock surface and the barrel 31 is forced backwardly over the wedges 32 to secure the strands 4. Grouting is then implemented.

Figure 12:
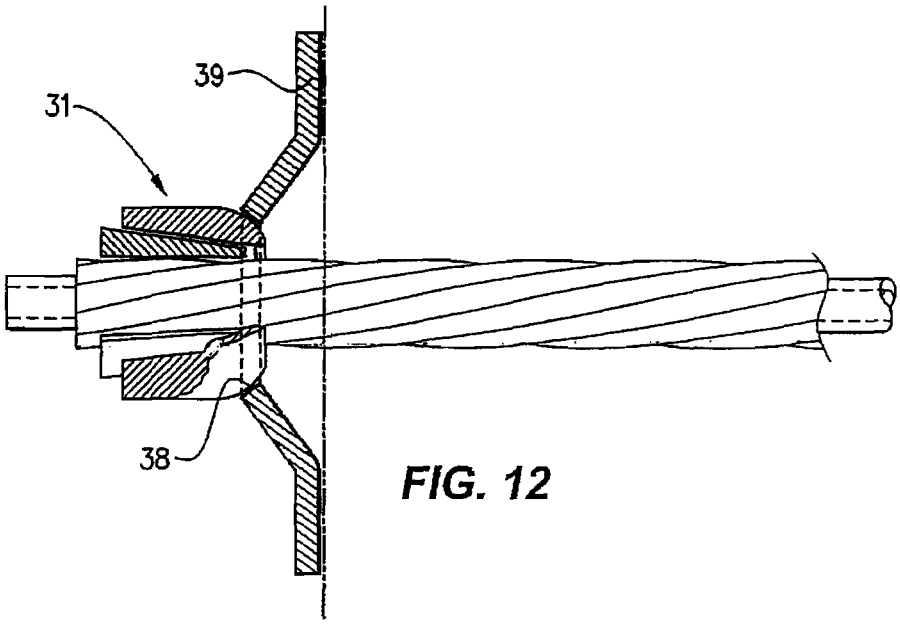
FIG. 12 is a side view of a portion of a rock bolt in accordance with an embodiment of the present invention.

FIG. 12 shows a portion of the embodiment of FIG. 8, showing a mounting plate 39 in section. The barrel 31 seats in a hole or recess 38 in the mounting plate 39.

Figure 11A:
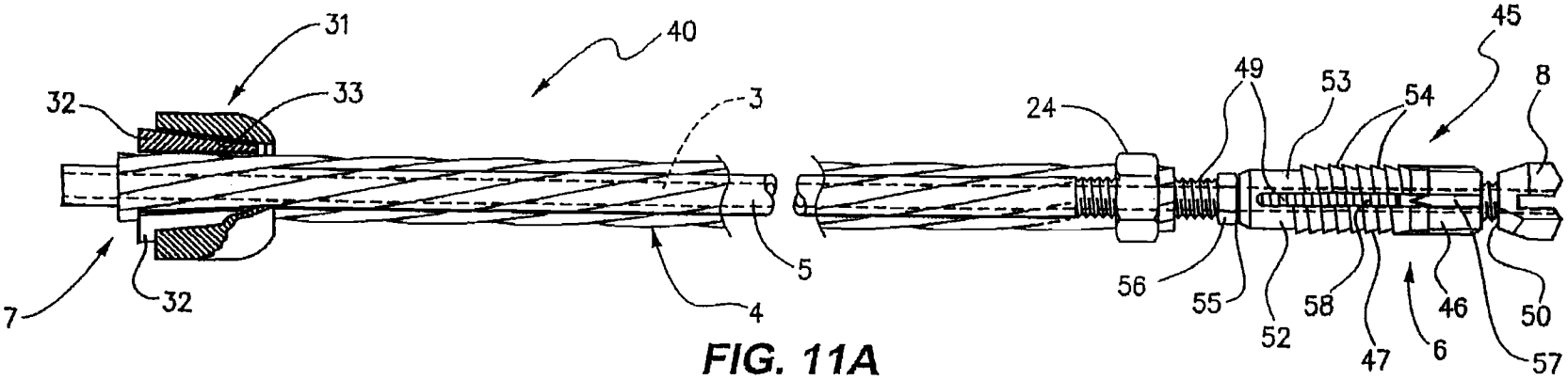
FIG. 11A is a side view of a rock bolt in accordance with yet a further embodiment of the present invention.
Figure 11B:
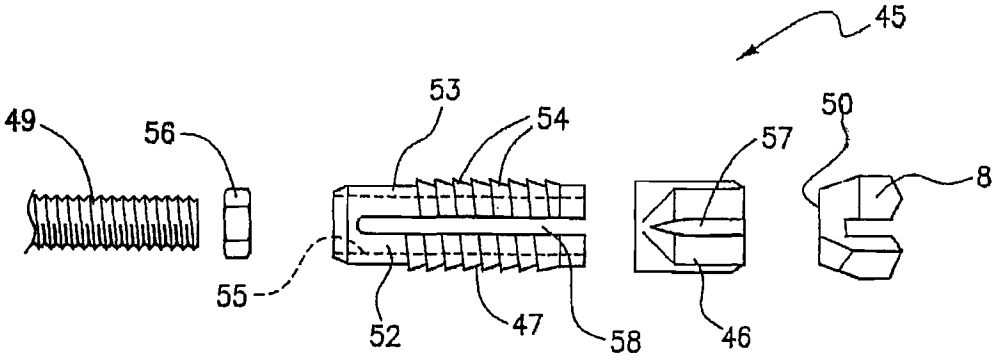
FIG. 11B is a detailed exploded view of a part of the rock bolt of the embodiment of FIG. 11A.

Yet a further embodiment is illustrated in FIGS. 11A and 11B.

The rock bolt 40 of FIG. 11*a* includes a mechanical anchoring arrangement, generally designated by reference numeral 45, at the distal end 6 of the rock bolt 40. The mechanical anchoring arrangement 45 is of similar construction to the mechanical anchoring arrangement disclosed in Australian provisional patent application number 2006903922, referenced above. The mechanical anchoring arrangement 45 operates to point anchor the rock bolt 40.

The mechanical anchoring arrangement 45 will now be described in more detail. Towards the distal end 6 of the rock bolt 40, the tubular member 5 is threaded with screw threads 49. The threaded portion 49 extends up to the drill bit 8. The drill bit 8 comprises a base forming a stop 50 where the threaded portion 49 meets the drill bit 8.

The mechanical anchoring arrangement 45 includes an expansion shell 47 and chuck 46. The expansion shell 47 in this example, has longitudinally extending leaves 52, 53 (note only two are shown in the drawings but there are three leaves). Note that the number of leaves on the expansion shell 47 could vary. For example, the leaves could vary from two to four. The leaves 52, 53 are arranged to move outwardly on expansion of the expansion shell 47 and are formed with a plurality of external protrusions 54 which assist in gripping the sides of the borehole to secure the rock bolt 40 in place. The expansion shell 47 also includes a bore 55 for sliding engagement with the threaded portion 49. An abutment member in the form of a threaded nut 56 is mounted on the threaded portion 49 and operates to prevent the expansion shell 47 from sliding further towards the tail end 7.

The chuck 46 has a threaded bore (not shown) for threaded engagement with the threaded portion 49. Rotation of the rock bolt 40 relative to the chuck 46 thus causes axial motion of the chuck 46 along the threaded portion 49. The chuck 46 includes tapered surfaces in sliding keying engagement with complementary surfaces on the extension leaves 52, 53, such that axial motion of the chuck 46 towards the tail end 7 relative to the expansion shell 47 will cause the leaves 52, 53 to diverge outwardly and grip the walls of the borehole. The chuck also includes projections 57 which extend into slots 58 formed between the leaves 52, 53 and prevent relative rotation of the chuck 46 and expansion shell 47 with respect to each other.

Stop 50 formed by the base of the drill bit 8 prevents chuck 46 and expansion shell 47 from moving over the distal end of the rock bolt 40.

The protrusions 54 are in a spiral formation, to assist with the flow of fluid during drilling, and aid in clearance of filings/cuttings. The spiral runs in the opposite direction to the thread form i.e. right hand spiral for left hand thread.

Installation of the rock bolt 40 will now be described.

A drill rig and spanner is attached to the rock bolt. Drilling into the rock substrate is implemented by rotating the rock bolt in the clockwise direction (in this embodiment). It will be appreciated that a reverse threaded arrangement may be rotated in the anticlockwise direction. As drilling proceeds, the expansion shell 47 may resist rotation as it abuts the walls of the borehole, and this will result in relative anticlockwise rotation of the expansion shell 47 and chuck 46 relative to the rock bolt 40. This will cause the chuck 46 to travel along the threaded portion 49 towards the distal end of the rock bolt 40 where it will abut the flat 50. Once flat 50 is engaged by the chuck 46 then the expansion shell 47 and chuck 46 will continue to rotate in the drilling direction with the rock bolt 40.

Once the rock bolt 40 has created a borehole of the desired length, drilling in the forward direction is ceased and rotation in the reverse direction (anticlockwise in this embodiment) is applied by the drill rig. By virtue of the anticlockwise motion of the threaded portion 49, the chuck 46 will now move towards the tail end 7. As the chuck 46 moves along the threaded portion 49, the tapered surfaces in sliding keying engagement with the complementary surfaces on the extension leaves 52, 53, cause the expansion shell 47 to expand outwardly. The protrusions 54 on the external surfaces of the leaves 52, 53 engage the walls of the borehole and mechanically secure the rock bolt 40 in place and provide tension to the reinforcement member.

Grouting the rock bolt 40 can then be carried out as discussed with reference to the previous embodiments.

FIG. 11B shows a exploded view of the head end of the rock bolt 40 of FIG. 11A, more clearly showing the components of the point anchoring mechanism.

The tail end of the rock bolt 40 may have any securing arrangement. In FIG. 11A, the securing arrangement comprises a barrel 31 and wedge 32 assembly as shown.

Figure 13:
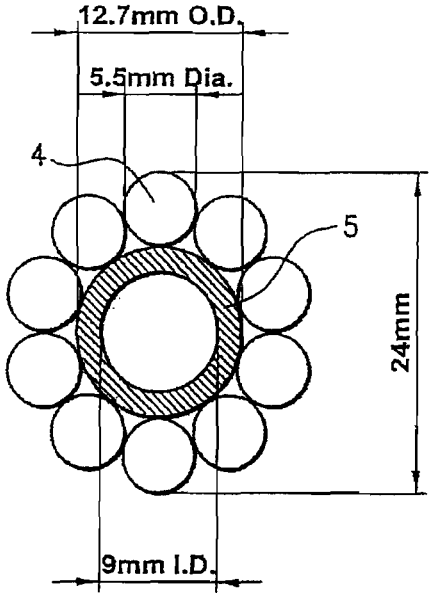
FIG. 13 is a cross-section through the shank of a rock bolt in accordance with an embodiment of the present invention.
Figure 14:
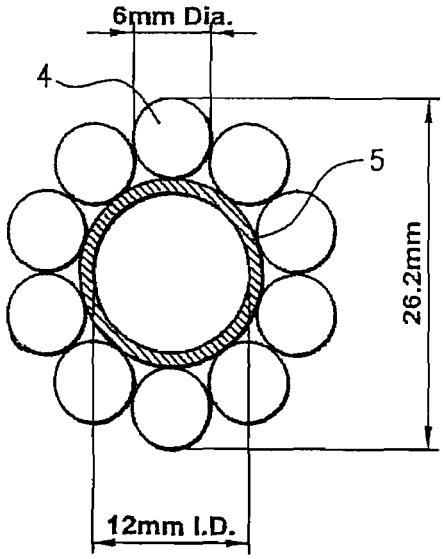
FIG. 14 is a cross-section through a shank of a rock bolt in accordance with a further embodiment of the present invention.

FIGS. 13 and 14 show cross sections through the shanks of rock bolts in accordance with embodiments of the present invention. These diagrams illustrate that different widths of reinforcing strands and different dimensions of tubular member may be utilised. In FIG. 13, for example, strands 4 may be 6 mm in diameter and the internal diameter of the tube 5 is 12 mm. Relatively large particle grout can be used with increasing hollow tube internal diameter.

The arrangement of FIG. 14, on the other hand, has smaller diameter strands 4 (5.5 mm) and a smaller diameter tube 5 (12.7 mm), for possible resin injection.

The rock bolt of the present invention is not limited to the dimensions shown in FIGS. 13 and 14. These are example dimensions only.

In the above embodiments, the reinforcing arrangement is formed by strands of strong material (such as steel). Other materials then steel may be used for the strands. Further, the reinforcing arrangement may comprise other forms than strands. For example, a webbing of strong material may form the reinforcing arrangement.

All the above embodiments relate to self drilling rock bolts. The present invention is not limited to self drilling rock bolts. A conventional rock bolt with a hollow tube and reinforcing arrangement also falls within the scope of the present invention.

In the above embodiments, various arrangements are illustrated and described for securing the reinforcing arrangement at the head and tail of the rock bolt. Other arrangements than described may be utilised. For example, in a simple embodiment, the strand may be welded at the head end and also welded at the tail end.

In the above embodiments, the reinforcing arrangement comprises reinforcing strands of a metal material, such as PC Steel. The reinforcing arrangement may be of other material. For example, it may comprise fibreglass or plastics. It may comprise fibreglass or plastics strand. Any other suitable material may be used.

In the above embodiments, the tubular members of hollow steel pipe or other metal material. It may be of any other suitable material, such as fibreglass, for example.

In embodiments of the invention, there is the advantage that the tubular member holds the initial tension and then the reinforcing arrangement, in examples being reinforcing strand, takes over the load when the rock bolt is secured in the bore e.g. by grouting.

In the claims which follow and in the preceding description of the invention, except where the context requires otherwise due to express language or necessary implication, the word "comprise" or variations such as "comprises" or "comprising" is used in an inclusive sense, i.e. to specify the presence of the stated features but not to preclude the presence or addition of further features in various embodiments of the invention.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The claims defining the invention are as follows:

1. A rock bolt comprising:

a shank portion comprising a rigid, hollow tubular member and a reinforcing arrangement comprising strands of material mounted about an outer wall of the hollow tubular member; and a drill bit mounted on the rigid, hollow tubular member, wherein the rigid, hollow tubular member is configured to provide sufficient strength to withstand rotation and impact of the drill bit with rock when the rock bolt is utilized to drill into the rock, wherein the reinforcing arrangement is secured to a first end of the rigid, hollow tubular member by a drive nut having a plurality of bores for receiving the strands of material, the strands of material each having a button head to secure the strands of material within the plurality of bores of the drive nut.

2. The rock bolt of claim 1, wherein the rigid, hollow tubular member comprises pipe formed from mild steel.

3. The rock bolt of claim 2, wherein the pipe is about 10-22 mm in diameter.

4. The rock bolt of claim 1, wherein the reinforcing arrangement is secured to the rigid, hollow tubular member via welding.

5. The rock bolt of claim 1, wherein the reinforcing arrangement is secured to a second end of the rigid, hollow tubular member by a reinforcing nut.

6. The rock bolt of claim 1, wherein the reinforcing arrangement is configured to carry at least 95% of a load received by the rock bolt when the rock bolt is installed in a borehole defined by a rock mass.

7. The rock bolt of claim 1, wherein the reinforcing arrangement provides deformations in an outer surface of the rock bolt that are configured to improve bonding to a rock bolt borehole.

8. The rock bolt of claim 1, wherein the strands of material comprise metal strands.

9. The rock bolt of claim 8, wherein the metal strands are a spiral type PC wire.

10. The rock bolt of claim 8, wherein the metal strands are wound about the rigid, hollow tubular member.

11. The rock bolt of claim 10, wherein the rock bolt is tensionable by increasing winding tension of the strand about the tubular member.

12. The rock bolt of claim 1, wherein the strands of material are indented to provide deformations.

13. A rock bolt comprising:

a shank portion comprising a rigid, hollow tubular member and a reinforcing arrangement comprising strands of material mounted about an outer wall of the hollow tubular member; and a drill bit mounted on the rigid, hollow tubular member, wherein the rigid, hollow tubular member is configured to provide sufficient strength to withstand rotation and impact of the drill bit with rock when the rock bolt is utilized to drill into the rock, wherein the reinforcing arrangement is secured to the rigid, hollow tubular member by a securing arrangement comprising a cylinder having a wedge arrangement mounted about an outer surface of the strands of material of the reinforcing arrangement.

14. The rock bolt of claim 13, wherein the securing arrangement further comprises a retention nut positioned about the cylinder.

* * * * *